US008094171B2

(12) United States Patent
Yang et al.

(10) Patent No.: US 8,094,171 B2
(45) Date of Patent: Jan. 10, 2012

(54) ROTATION DRIVING METHOD OF LIQUID CRYSTAL DISPLAY DEVICE

(75) Inventors: Dong-Kyu Yang, Goyang-si (KR); Jin-Sang Lee, Chungbuk (KR)

(73) Assignee: LG Display Co., Ltd., Seoul (KR)

( * ) Notice: Subject to any disclaimer, the term of this patent is extended or adjusted under 35 U.S.C. 154(b) by 630 days.

(21) Appl. No.: 12/318,163

(22) Filed: Dec. 22, 2008

(65) Prior Publication Data

US 2010/0001935 A1 Jan. 7, 2010

(30) Foreign Application Priority Data

Jul. 1, 2008 (KR) ..... 10-2008-0063451

(51) Int. Cl.
*G09G 5/00* (2006.01)
*G09G 3/36* (2006.01)

(52) U.S. Cl. ..... 345/649; 345/659; 345/87

(58) Field of Classification Search ..... 345/659, 345/649
See application file for complete search history.

(56) References Cited

U.S. PATENT DOCUMENTS

| | | | | |
|---|---|---|---|---|
| 5,973,664 | A * | 10/1999 | Badger | 345/659 |
| 6,643,415 | B1 * | 11/2003 | Fukai et al. | 345/659 |
| 7,268,764 | B2 * | 9/2007 | Song et al. | 345/100 |
| 2002/0186229 | A1 * | 12/2002 | Brown Elliott | 345/649 |
| 2006/0033760 | A1 * | 2/2006 | Koh | 345/649 |
| 2006/0158418 | A1 * | 7/2006 | Kieschnick et al. | 345/100 |

* cited by examiner

*Primary Examiner* — Alexander S Beck
*Assistant Examiner* — Joseph Pena
(74) *Attorney, Agent, or Firm* — McKenna Long & Aldridge, LLP.

(57) ABSTRACT

A rotation driving method of a LCD device includes a first step of rotating the LCD device 180° such that source driving units are disposed at a lower portion of the liquid crystal panel, a second step of outputting scan signals from gate driving units in reverse order, a third step of reestablishing image data provided to the source driving units, a fourth step of reversing arrangement of the image data outputted to sub-pixels, a fifth step of shifting and outputting the image data corresponding to selected odd horizontal lines and even horizontal lines by one sub-pixel, a sixth step of exchanging the image data for the first and third sub-pixels with each other, and a seventh step of outputting the image data rearranged by the third to sixth steps to the liquid crystal panel such that the image data synchronize with the scan signals according to the second step.

6 Claims, 16 Drawing Sheets

ROTATION DRIVING METHOD OF LIQUID CRYSTAL DISPLAY DEVICE

This application claims the benefit of Korean Patent Application No. 10-2008-0063451, filed in Korea on Jul. 1, 2008, which is hereby incorporated by reference for all purposes as if fully set forth herein.

BACKGROUND OF THE INVENTION

1. Field of the Disclosure

The present invention relates to a liquid crystal display device, and more particularly, to a rotation driving method of a liquid crystal display device.

2. Discussion of the Related Art

Among display devices, liquid crystal display (LCD) devices have advantages of small sizes, thin thicknesses and low power consumption and have widely used for notebook computers, office automation equipment, and audio/video equipment. Particularly, active matrix liquid crystal display (AMLCD) devices including thin film transistors as switching elements are fit for displaying moving images.

FIG. 1 is a view of schematically illustrating an LCD device 100 according to the related art. FIG. 1 shows a liquid crystal panel 110, source driving units SD1 to DS6, and gate driving units GD1 to GD4.

The liquid crystal panel 110 includes gate lines GL1 to GLn and data lines DL1 to DLm which are formed on a substrate such as a glass substrate and cross each other to define pixel regions. A thin film transistor TFT, a liquid crystal capacitor Clc and a storage capacitor Cst are formed in each pixel region, and this is defined as a sub-pixel. Red, blue and green sub-pixels constitute a pixel.

The sub-pixels are formed at crossing portions of the data lines DL1 to DLm and the gate lines GL1 to GLn and are disposed in a matrix shape. The area, where image data are provided to the sub-pixels and images are displayed, may be referred to as an active area A/A.

Each of the source driving units SD1 to SD6 outputs the image data to the data lines DL1 to DLm to provides the liquid crystal panel with the image data, and each of the gate driving units GD1 to GD4 sequentially outputs scan signals to the gate lines GL1 to GLn to control switching of the thin film transistors TFT of the sub-pixels. Accordingly, the image data are provided to the sub-pixels to display the images.

In other models such as large-sized LCD devices, gate driving units may be attached at another side of the liquid crystal panel 110 to more smoothly display images.

Although not shown in the figure, the LCD device 100 further includes a timing control unit, a gamma reference voltage generating unit, a backlight unit and a power supply unit. The timing control unit provides the image data and data control signals to the source driving units SD1 to SD6 and supplies the gate driving units GD1 to GD4 with gate control signals including a gate output enable (GOE) signal which controls output of the scan signals. The gamma reference voltage generating unit provides gamma reference voltage to the source driving units SD1 to SD6. The backlight unit provides light to the liquid crystal panel 110. The power supply unit provides source voltages to the units.

To maximize efficiency, for example, to decrease power consumption, the LCD device has been developed variously. An example is shown in FIG. 2. FIG. 2 schematically illustrates data lines, gate lines and sub-pixels.

FIG. 2 is a view for explaining an inputting method of image data for an inversion driving mode.

In FIG. 2, sub-pixels are arranged in a matrix shape. Data lines DL1 to DLm are zigzag connected to the sub-pixels along a vertical direction, and gate lines GL1 to GLn are connected to the sub-pixels in a same horizontal line.

Since the data lines DL1 to DLm are zigzag connected to the sub-pixels, the image data are input to the sub-pixels through the data lines such that the image data of the sub-pixels in even horizontal lines precedes the image data of the sub-pixels in odd horizontal lines by one sub-pixel. This method can lower power consumption in a dot-inversion mode. Here, in the first image data, which may be B color image data in FIG. 2 and provided to the sub-pixels in the even horizontal lines, there is no real sub-pixels receiving the first image data as positions of the dot-lined sub-pixels B1, B2 and B3. Accordingly, the first image data is provided to the last sub-pixels in the same horizontal lines after providing the image data inputted to the last sub-pixels, that is, B color sub-pixels to thereby display images.

The decreasing effect of the power consumption in the LCD device of FIG. 2 will be explained with reference to FIG. 3. FIG. 3 is a view partially illustrating an input of image data in an LCD device according to related art.

In FIG. 3, a data line DL, which is represented as a dotted line, is zigzag connected to sub-pixels. Positive (+) image data is provided to the sub-pixels through the data line DL. Here, since only the positive (+) image data is outputted through the data line DL, voltage variation is minimized as compared to a method alternately inputting positive (+) and negative (−) image data. Therefore, the power consumption can be decreased.

In the LCD device 100 of FIG. 1 driven by various methods, a source driving unit SD is attached at an upper portion of the liquid crystal panel 110 using TCP (tape carrier package) and FPC (flexible printed circuit) and is connected to a control circuit board CB, and the control circuit board CB is disposed at a rear surface of the liquid crystal panel 100 as shown in FIG. 4. FIG. 4 shows a schematic side view of the LCD device according to the related art.

By the way, as the LCD device gets thinner recently, the LCD device for televisions includes a case 120 having a lower side part and an upper side part narrower than the upper side part as shown in FIG. 5. FIG. 5 shows a schematic side view of a product including an LCD device according to the related art. Accordingly, the LCD device, where driving circuits are attached at the upper portion of the liquid crystal panel 110, is not suitable for the case 120 having the thin upper side part.

SUMMARY OF THE INVENTION

Accordingly, the present invention is directed to a rotation driving method of a liquid crystal display device that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a rotation driving method of a liquid crystal display device, which includes a liquid crystal panel including pixels composed of first, second and third sub-pixels and arranged in a matrix shape, gate lines receiving scan signals, data lines zigzag connected to the sub-pixels and receiving image data, source driving units connected to the data lines and providing the image data to the data lines, gate driving units connected to the gate lines and providing the scan signals to the gate lines, a timing control unit providing the image data and control signals for driving the source driving units and the gate driving units, wherein the source driving units are disposed to an upper portion of the liquid crystal panel and the gate driving units are disposed at a side portion of the liquid crystal panel, includes a first step of rotating the liquid crystal display device at 180 degrees such that the source driving units are disposed at a lower portion of the liquid crystal panel, a second step of outputting the scan signals from the gate driving units in reverse order, a third step of reestablishing the image data provided to the source driving units, a fourth step of reversing arrangement of the image data outputted to the sub-pixels, a fifth step of shifting and outputting the image data corresponding to selected ones of odd horizontal lines and even horizontal lines by one sub-pixel, a sixth step of exchanging the image data for the first and third sub-pixels with each other, and a seventh step of outputting the image data rearranged by the third to sixth steps to the liquid crystal panel such that the image data synchronize with the scan signals according to the second step.

It is to be understood that both the foregoing general description and the following detailed description of the present invention are exemplary and explanatory and are intended to provide further explanation of the invention as claimed. Other systems, methods, features and advantages will be, or will become, apparent to one with skill in the art upon examination of the following figures and detailed description. Nothing in this section should be taken as a limitation on those claims. Further aspects and advantages are discussed below in conjunction with the embodiments. Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The system and/or method may be better understood with reference to the following drawings and description. Non-limiting and non-exhaustive embodiments are described with reference to the following drawings. The components in the figures are not necessarily to scale, emphasis instead being placed upon illustrating the principles of the invention. In the figures, like referenced numerals designate corresponding parts throughout the different views. The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to an embodiment of the present disclosure, an example of which is illustrated in the accompanying drawings.

In the present invention, an LCD device includes a liquid crystal panel, source driving units, gate driving units, a timing control unit. The liquid crystal panel includes pixels, each of which is composed of red, green and blue sub-pixels on a substrate, arranged in a matrix shape, gate lines receiving scan signals, and data lines zigzag connected to the sub-pixels and receiving image data. The source driving units are connected to the data lines at an upper portion of the liquid crystal panel and provide the image data to the data lines. The gate driving units are connected to the gate lines at a side portion of the liquid crystal panel and provide the scan signals to the gate lines. The timing control unit supplies the image data and provides control signals for driving the source driving units and the gate driving units.

The LCD device may be driven by a rotation driving method according to the present invention. In the rotation driving method, the LCD device of the related art may be rotated at 180 degrees and driven without additional elements.

Figure 1A:
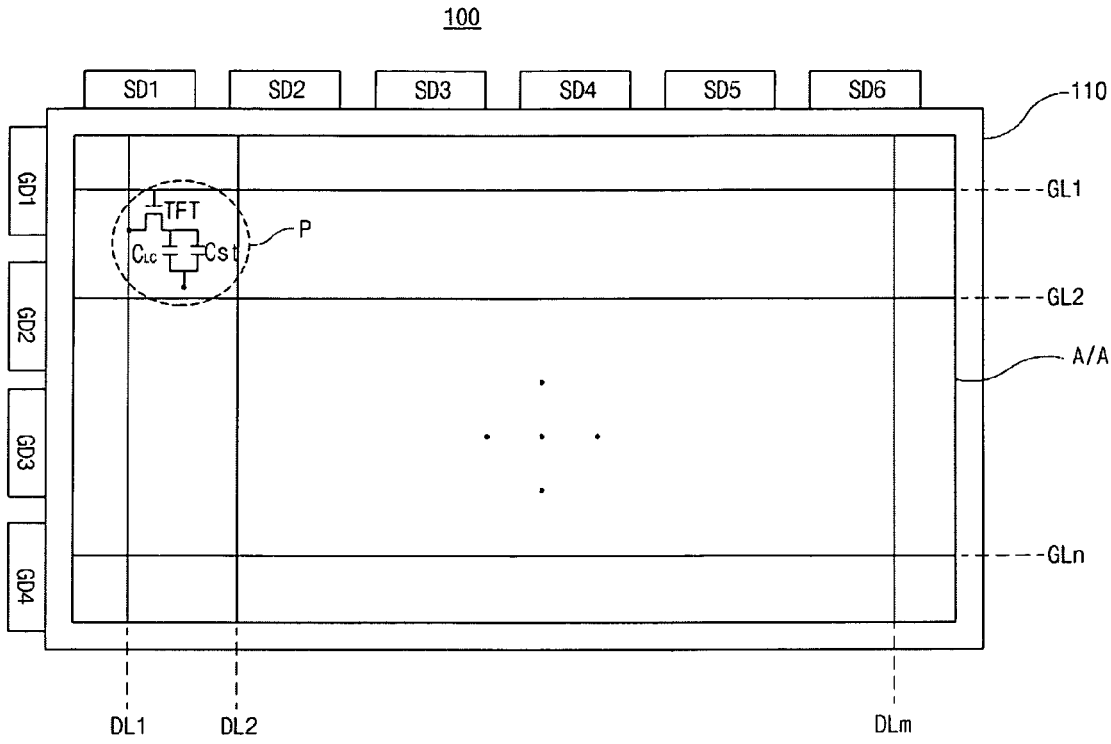
FIG. 1A RELATED ART
FIG. 1 is a view of schematically illustrating an LCD device 100 according to the related art.
Figure 2:
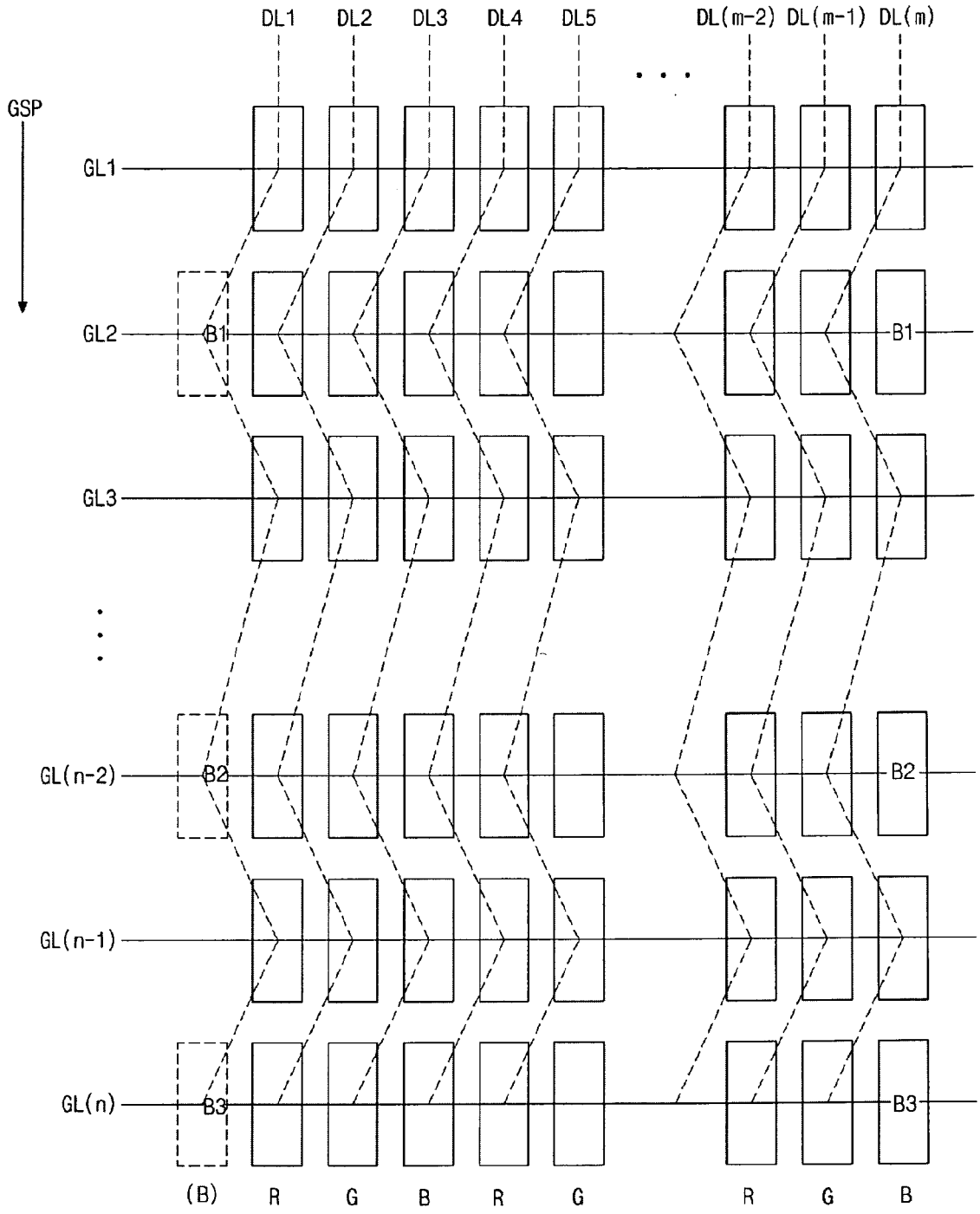
FIG. 2 RELATED ART
FIG. 2 is a view for explaining an inputting method of image data for an inversion driving mode.
Figure 3:
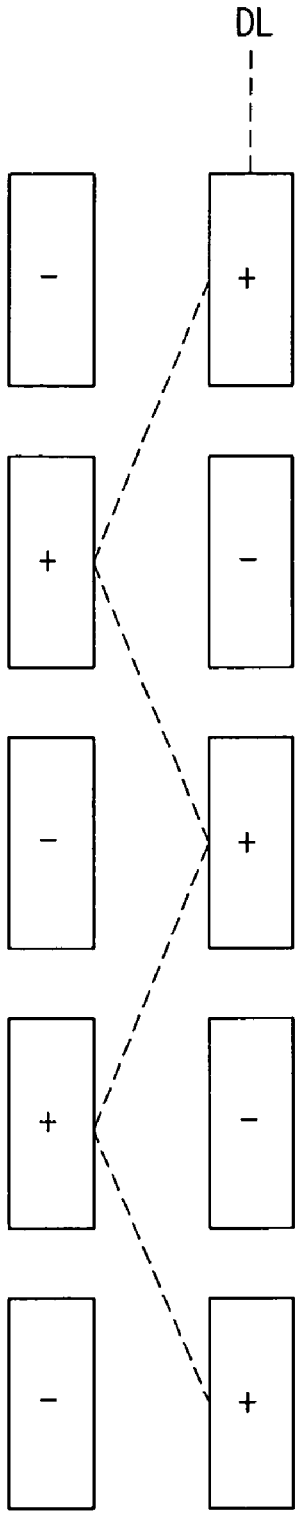
FIG. 3 RELATED ART
FIG. 3 is a view partially illustrating an input of image data in an LCD device according to related art.
Figure 4:
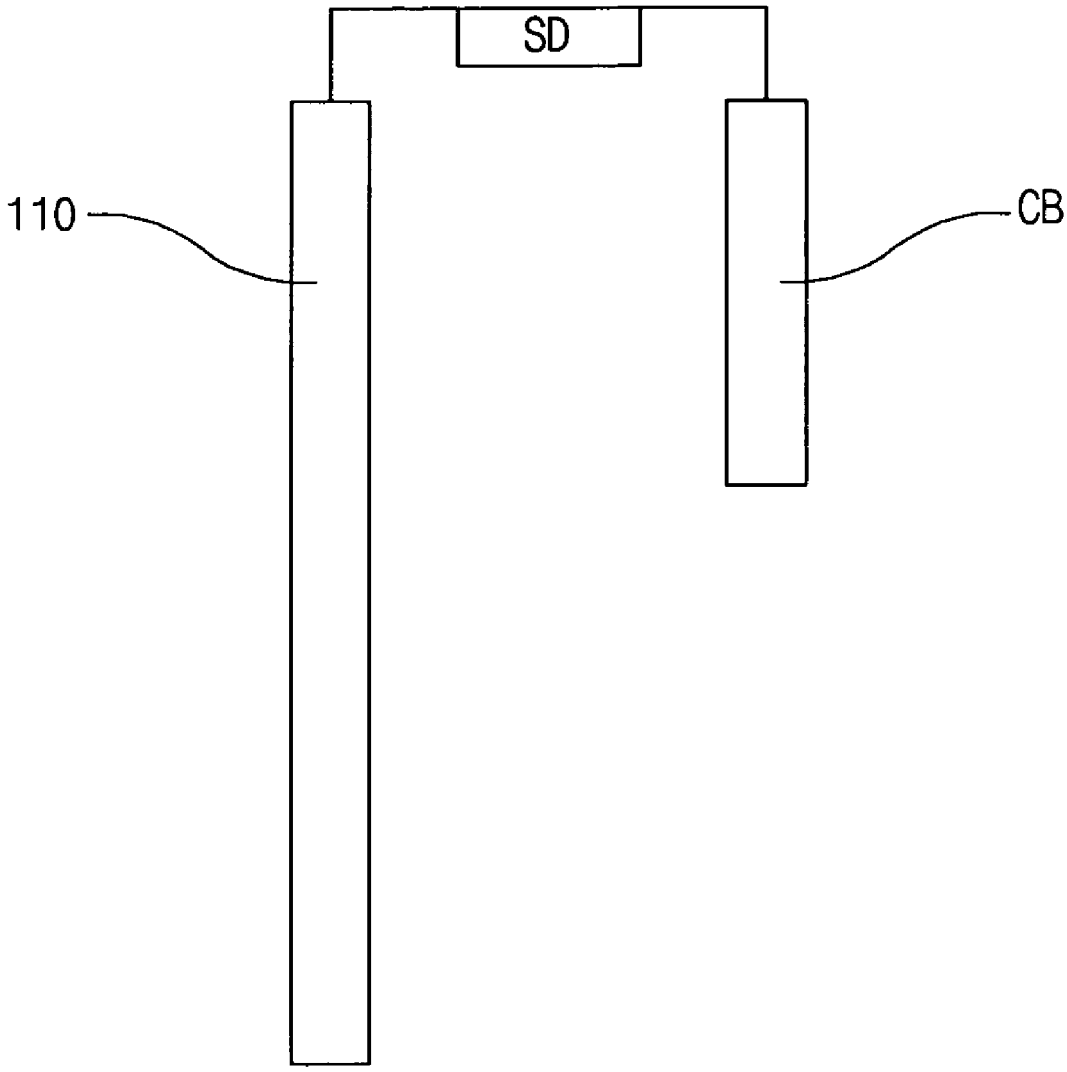
FIG. 4 RELATED ART
FIG. 4 is a schematic side view of the LCD device according to the related art.
Figure 5:
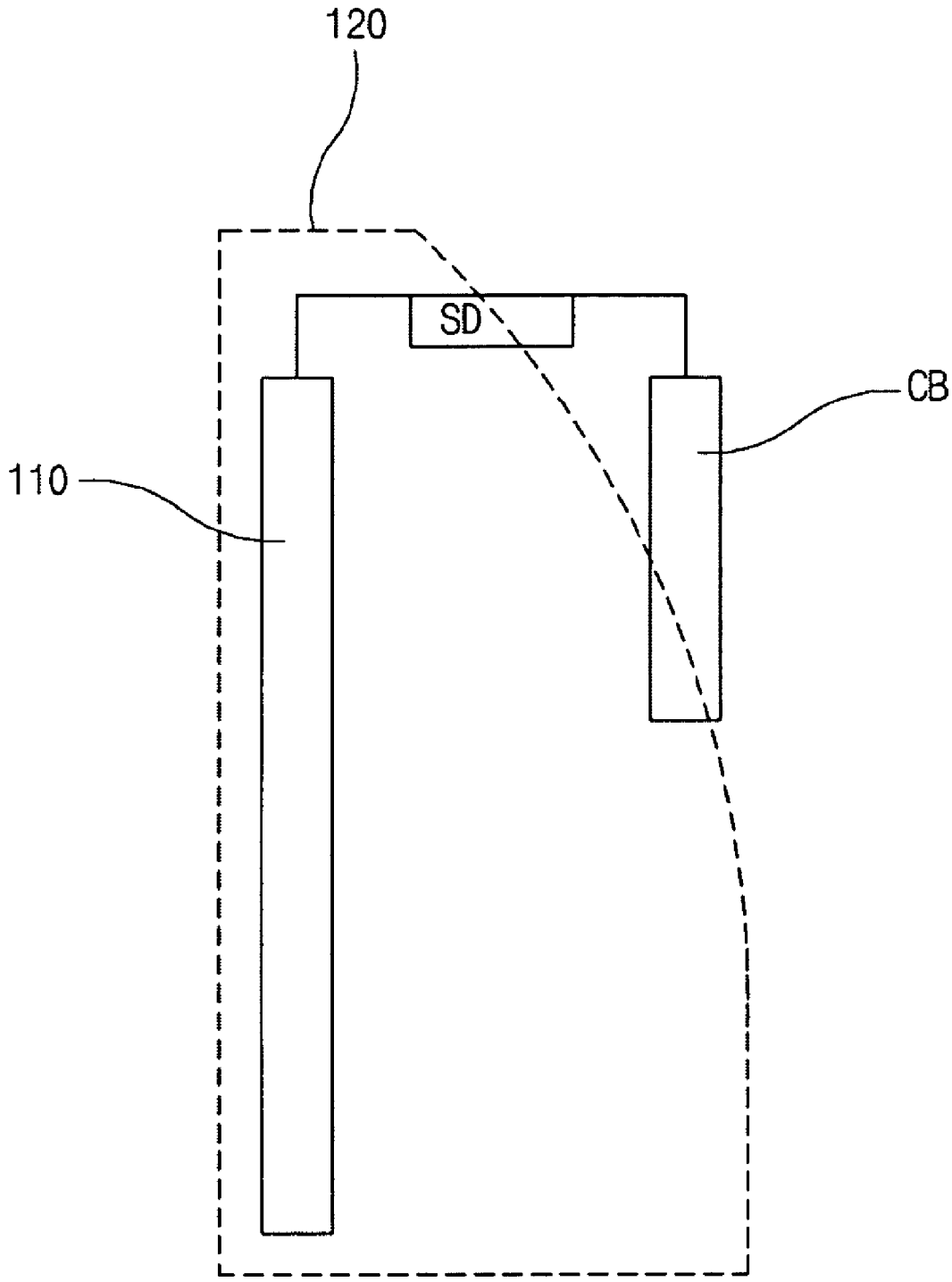
FIG. 5 RELATED ART
FIG. 5 is a schematic side view of a product including an LCD device according to the related art.
Figure 6A:
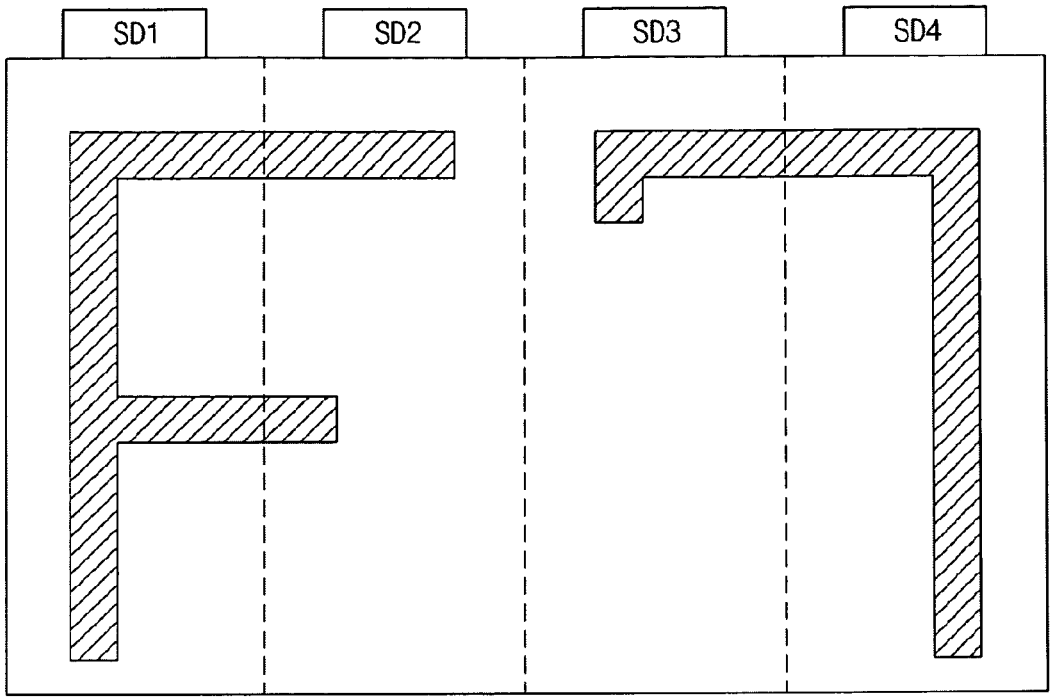
FIG. 6A RELATED ART
FIG. 6A is a view for explaining an image-displaying method according to the related art.
Figure 6B:
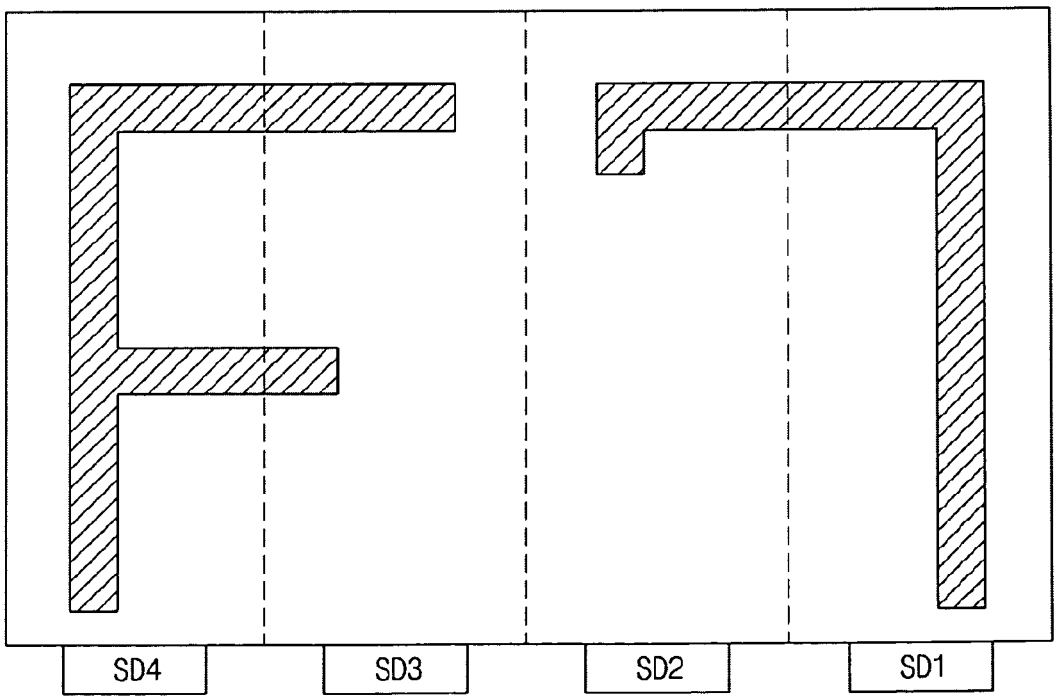
FIG. 6B is a view for explaining an image-displaying method according to the present invention.

FIG. 6A is a view for explaining an image-displaying method according to the related art, and FIG. 6B is a view for explaining an image-displaying method according to the present invention.

In the related art of FIG. 6A, the source driving units SD1 to SD4 are disposed at the upper portion of the liquid crystal panel in the context of the figure. On the other hand, in the present invention of FIG. 6B, the source driving units SD1 to SD4 are disposed at the lower portion of the liquid crystal panel in the context of the figure, wherein the liquid crystal panel of FIG. 6B is the same as the liquid crystal panel of FIG. 6A rotated at 180 degrees. The liquid crystal panel of FIG. 6B displays the same image as the liquid crystal panel of FIG. 6A. That is, according to a driving method of the present invention, even though the related art liquid crystal panel rotates at 180 degrees, the rotated liquid crystal panel displays the image the same as when the liquid crystal panel does not rotate. Here, the dotted lines mean boundaries between image display sections corresponding to the source driving units SD1 to SD4.

Figure 7:
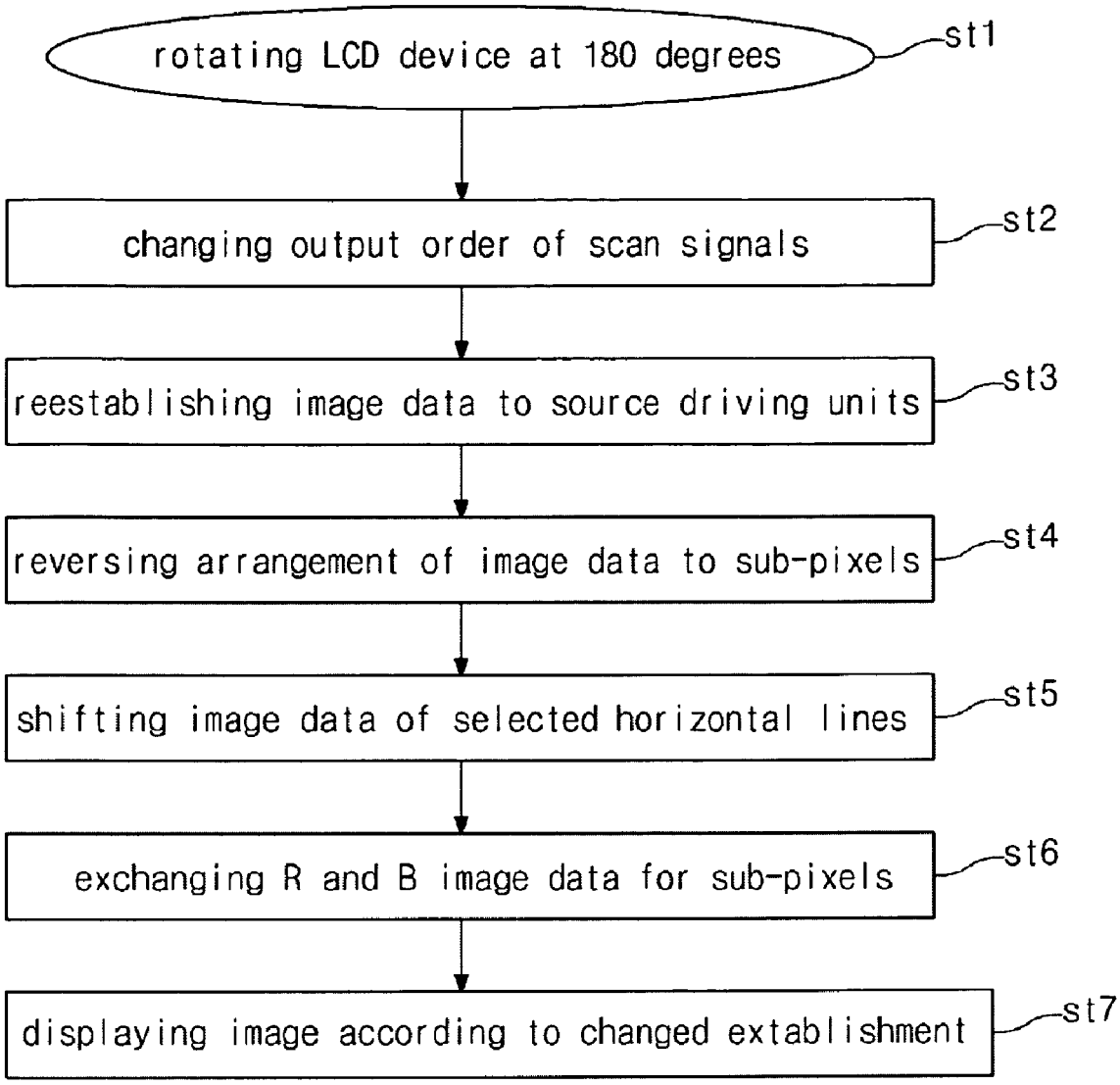
FIG. 7 is a flow chart for explaining a rotation driving method of an LCD device according to the present invention.

FIG. 7 is a flow chart for explaining a rotation driving method of an LCD device according to the present invention.

FIG. 8, FIG. 9, FIG. 10 and FIG. 11 are views of illustrating statuses of a liquid crystal panel in steps of FIG. 7.

Figure 8:
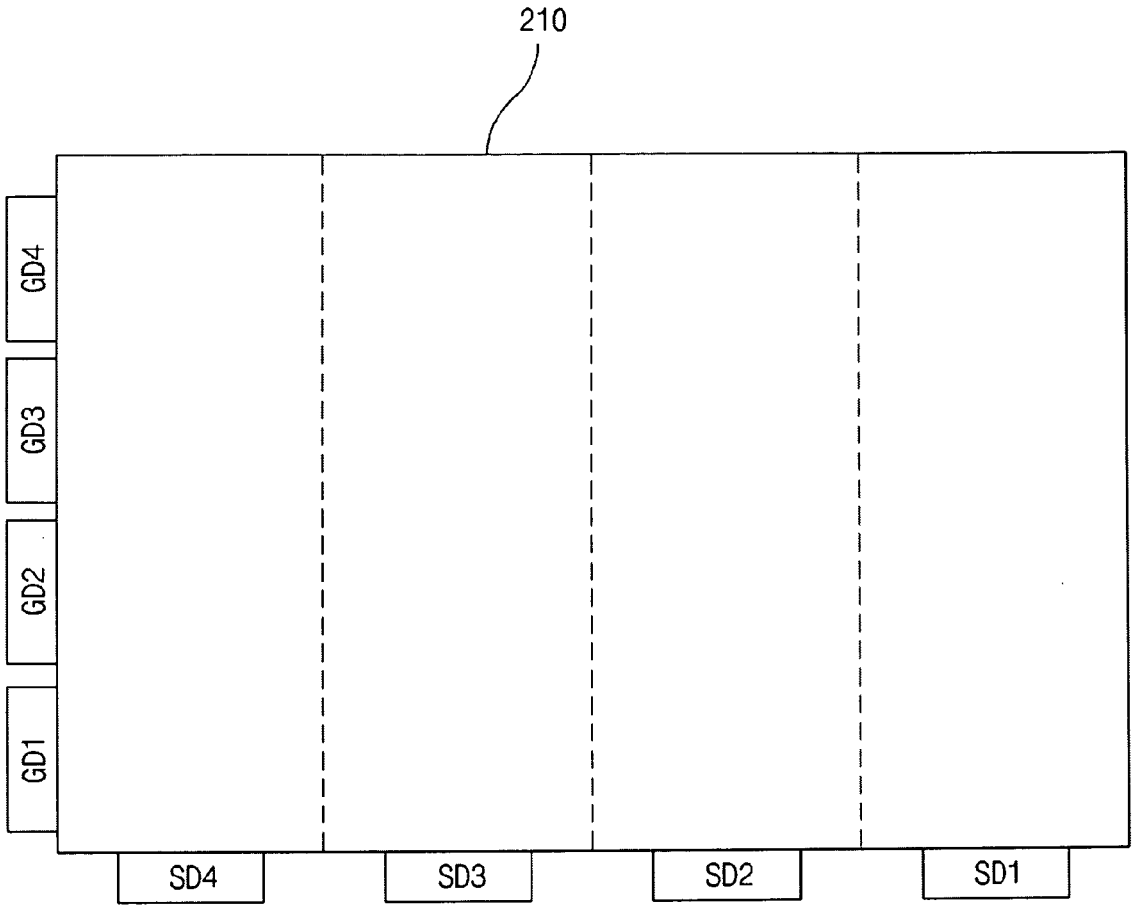
FIG. 8, FIG. 9, FIG. 10 and FIG. 11 are views of illustrating statuses of a liquid crystal panel in steps of FIG. 7.

At first step st1 of FIG. 7, the LCD device including a liquid crystal panel 210, in which data lines are formed, is rotated at 180 degrees. According to this, as shown in FIG. 8, source driving units SD1 to SD4 are disposed at a lower portion of the liquid crystal panel 210 and are arranged in order of SD4, SD3, SD2 and SD1 from left to right in the context of the figure. Gate driving units GD1 to GD4 are disposed at a side portion of the liquid crystal panel 210 and are arranged in order of GD4, GD3, GD2 and GD1 from top to bottom in the context of the figure.

Here, since providing scan signals from the side portion of the liquid crystal panel 210 is the same at right and left side portions of the liquid crystal panel 210, for convenience of explanation, the gate driving units GD1 to GD4 are disposed at a left side portion of the liquid crystal panel 210 in FIG. 8.

After rotating the LCD device at 180 degrees, it is needed to change operation of the source driving units SD1 to SD4 and the gate driving units GD1 to GD4 to normally display an image.

At second step st2, an output order of the scan signals from the gate driving units GD1 to GD4 is changed. More particularly, after rotation of the LCD device, the scan signals are outputted to the gate lines from bottom to top, and to display the image from top to bottom of the liquid crystal panel 210 of FIG. 8, the output order of the scan signals is reestablished such that the scan signals are outputted from top to bottom. Therefore, an outer circuit unit provides a signal, for example, GSP-reverse signal, to the timing control unit (not shown), and the timing control unit uses an operation program, which may be provided in advance, and provides a gate output enable signal GOE to the fourth gate driving unit GD4. Accordingly, the scan signals are sequentially outputted from a first shift register after the rotation, which is a last shift register before the rotation, to a last one.

That is, the shift registers connected to each other in the gate driving units GD1 to GD4 and outputting the scan signals are driven in reverse order, and the scan signals are sequentially outputted to the liquid crystal panel 210 from top to bottom in FIG. 8.

At third step st3, image data provided to the source driving units SD1 to SD4 are reestablished.

Figure 9:
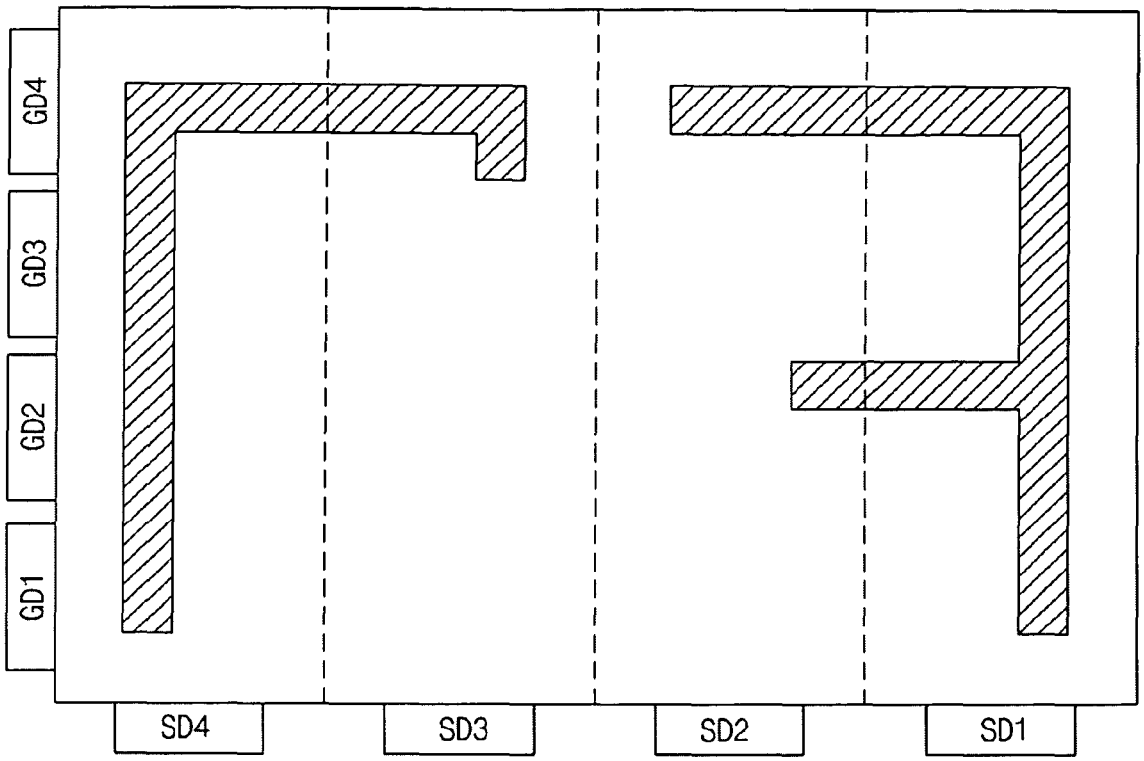

When considering the image of FIG. 6A, if the image data after the rotation are provided in the same way as before the rotation, an abnormal image is displayed as shown in FIG. 9.

Accordingly, it is needed to change the image data provided to the first to fourth source driving units SD1 to SD4. First, the image data provided to the first to fourth source driving units SD1 to SD4 before the rotation are divided according to an arrangement order of the source driving units SD1 to SD4. Next, the divided image data before the rotation are provided to the source driving units SD1 to SD4 rearranged after the rotation in order.

Figure 10:
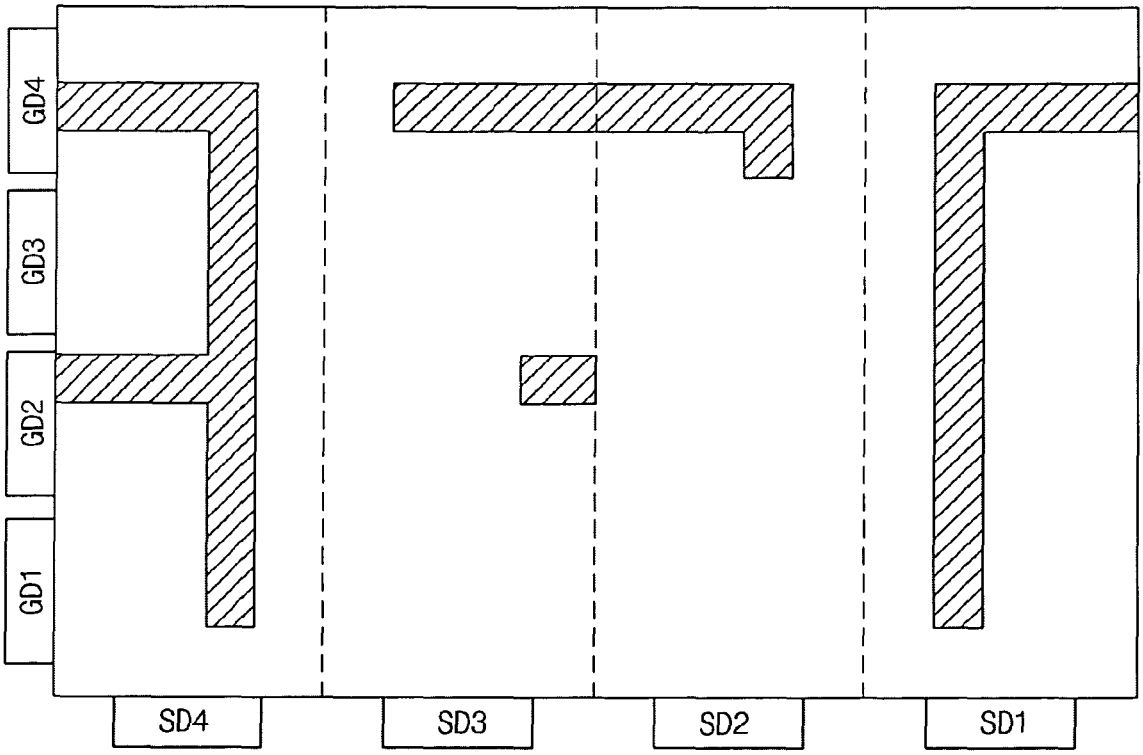

That is, as shown in FIG. 10, the image data provided to the first source driving unit SD1 before the rotation are provided to the fourth source driving unit SD4 after the rotation. The image data provided to the second source driving unit SD2 before the rotation are provided to the third source driving unit SD3 after the rotation. The image data provided to the third source driving unit SD3 before the rotation is provided to the second source driving unit SD2 after the rotation. The image data provided to the fourth source driving unit SD4 before the rotation is provided to the first source driving unit SD1 after the rotation.

It is desirable that the change in setting is made in the timing control unit providing the image data to the source driving units SD1 to SD4. More beneficially, an outer circuit unit provides an additional signal to the timing control unit, and the image data are reestablished by an operation program provided in the timing control unit in advance according to the additional signal.

At fourth step st4, the source driving units SD1 to SD4 rearrange the image data provided to the sub-pixels of the liquid crystal panel 210 of FIG. 8.

That is, parts of the image shown in FIG. 10 after the third step st3 are needed to be reversed left and right in each of sections corresponding to the source driving units SD1 to SD4. Therefore, the source driving units SD1 to SD4 rearrange the image data for the sub-pixels of a horizontal line sequentially provided from the timing control unit according to the opposite order to the input order or receive image data previously rearranged. Beneficially, an outer circuit unit provides an additional signal, for example, an L/R option signal, to the timing control unit, and the image data are reestablished by an operation program provided in the timing control unit in advance according to the additional signal as second step st2 and third step st3.

Accordingly, the image data are classified by horizontal lines, and then the image data corresponding to one horizontal line are rearranged in reverse order.

More particularly, if the timing control unit provides the source driving units SD1 to SD4 with the image data corresponding to the horizontal line from left to right before the rotation of the LCD device, the timing control unit provides the source driving unit SD1 to SD4 with the image data corresponding to the horizontal line from right to left after the rotation of the LCD device. The arrangement of the source driving units after the rotation, that is, the order the fourth, third, second and first driving units SD4, SD3, SD2 and SD1 are opposite to the arrangement of the source driving units before the rotation, that is, the first, second, third and fourth units SD1, SD2, SD3 and SD4. Thus, the image data corresponding to the horizontal line are reversely arranged and provided to the source driving units SD1 to SD4.

Figure 11:
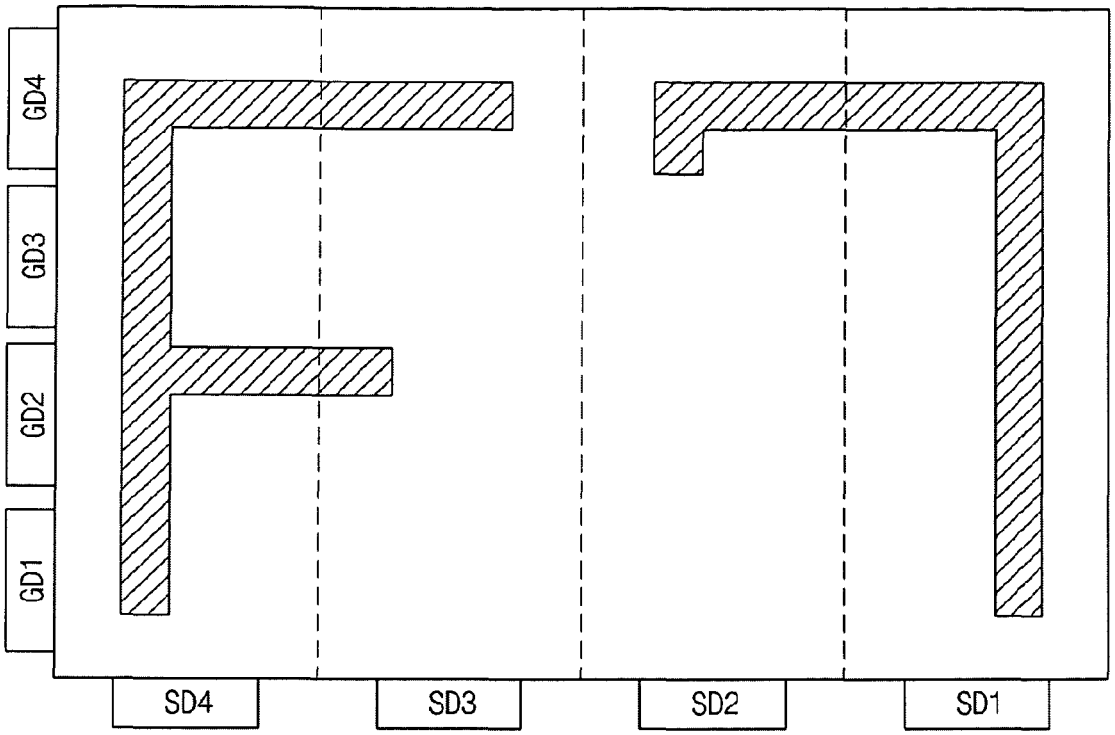

According to fourth step st4, a normal arrangement of the image data is performed as shown in FIG. 11.

Here, the third step st3 and the fourth step st4 can be exchanged.

By the way, as stated above, the rotation driving method is applied to the LCD device, in which the data lines are zigzag connected to the sub-pixels, and the color and shape of the image may be distorted according to the first to fourth steps st1 to st4.

This will be explained with reference to FIG. 12 and FIGS. 13A to 13C.

Figure 12:
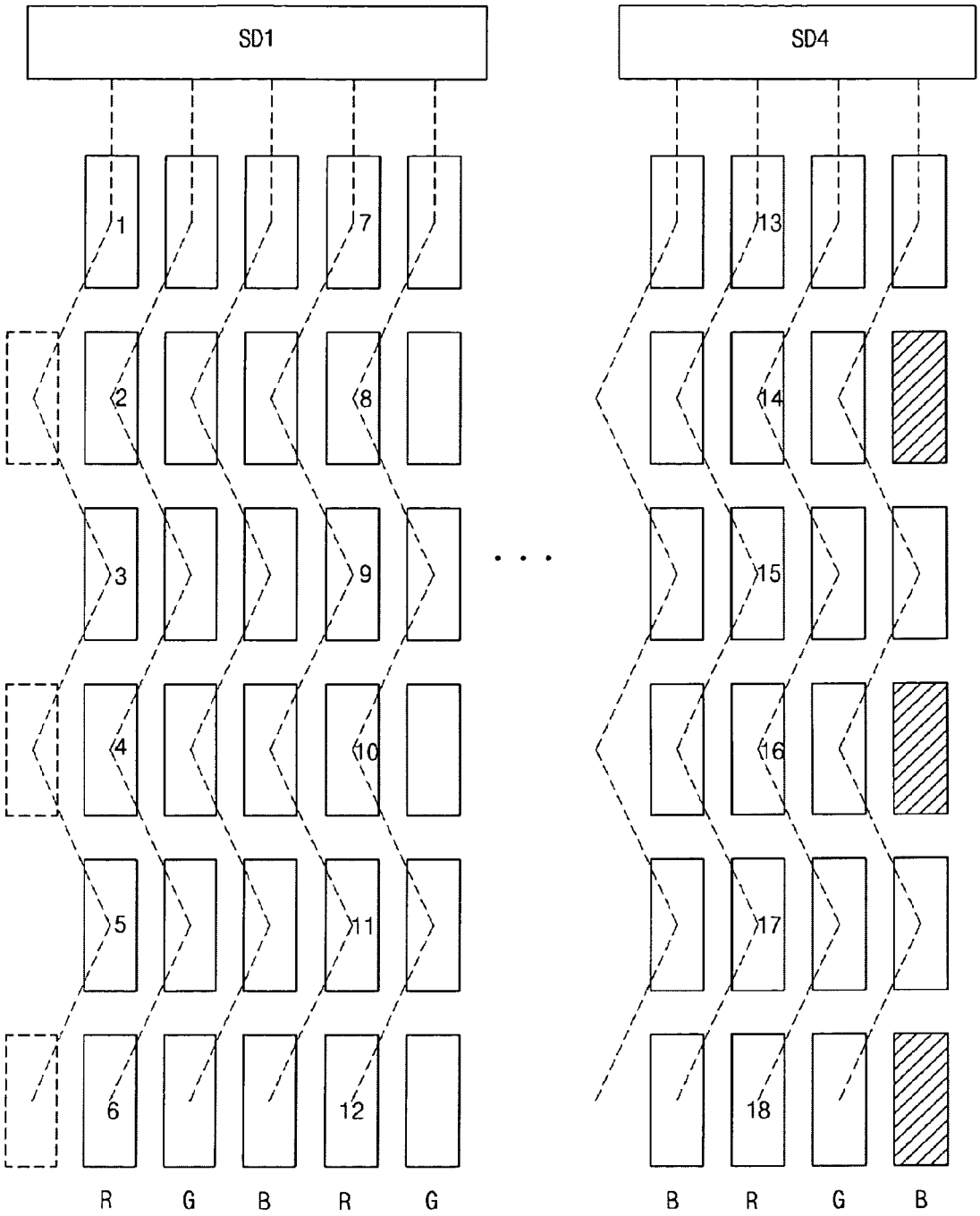
FIG. 12 is a view of an input status of image data in an LCD device driven by a rotation driving method according to the present invention after rotating the LCD device.

FIG. 12 is a view of an input status of image data in an LCD device driven by a rotation driving method according to the present invention after rotating the LCD device. FIG. 12 shows inputting R-data to R (red) color sub-pixels in an image display area by the first source driving unit SD1 and the fourth source driving unit SD4 in FIG. 8 is a comparing view for explaining the rotation driving method according to the present invention.

Here, the first image data of even horizontal lines correspond to dot-lined sub-pixels, which do not exist, and are actually provided to hatched sub-pixels, which are last sub-pixels in the same horizontal lines.

Figure 13A:
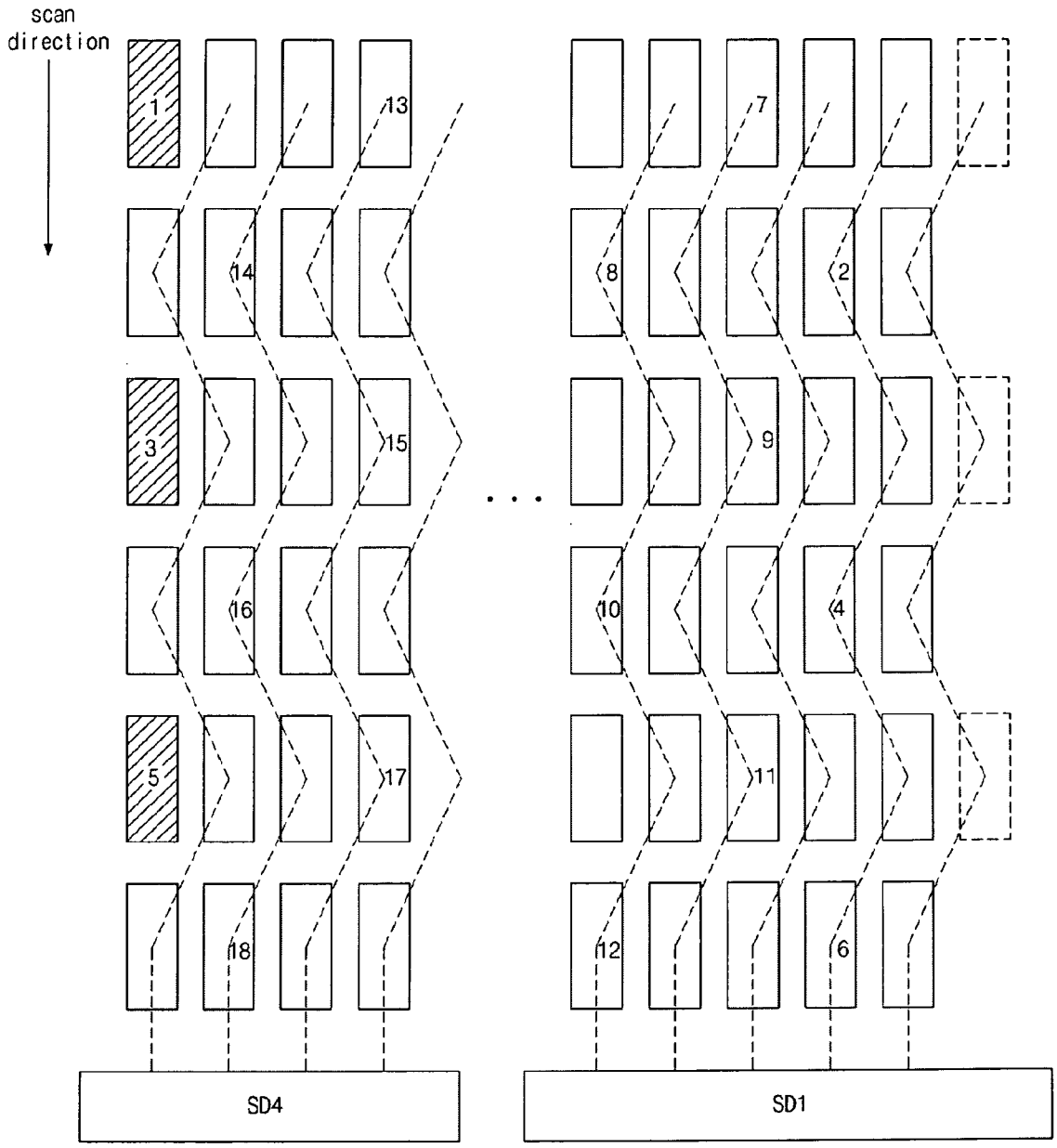
FIGS. 13A to 13C, FIG. 14 and FIG. 15 are views of input statuses of image data in an LCD device driven by a rotation driving method according to the present invention.

Referring to FIG. 12, which shows the input position of R-data before the rotation, the input status of the image data in the LCD device is shown in FIG. 13A after the first step st1 and the second step st2.

In FIG. 13A, the image data corresponding to the dot-lined sub-pixels from the last data line of the first source driving unit SD1 are inputted to the first sub-pixels of the odd horizontal lines, that is, the hatched sub-pixels, and this is a result of performing operation corresponding to FIG. 9.

Figure 13B:
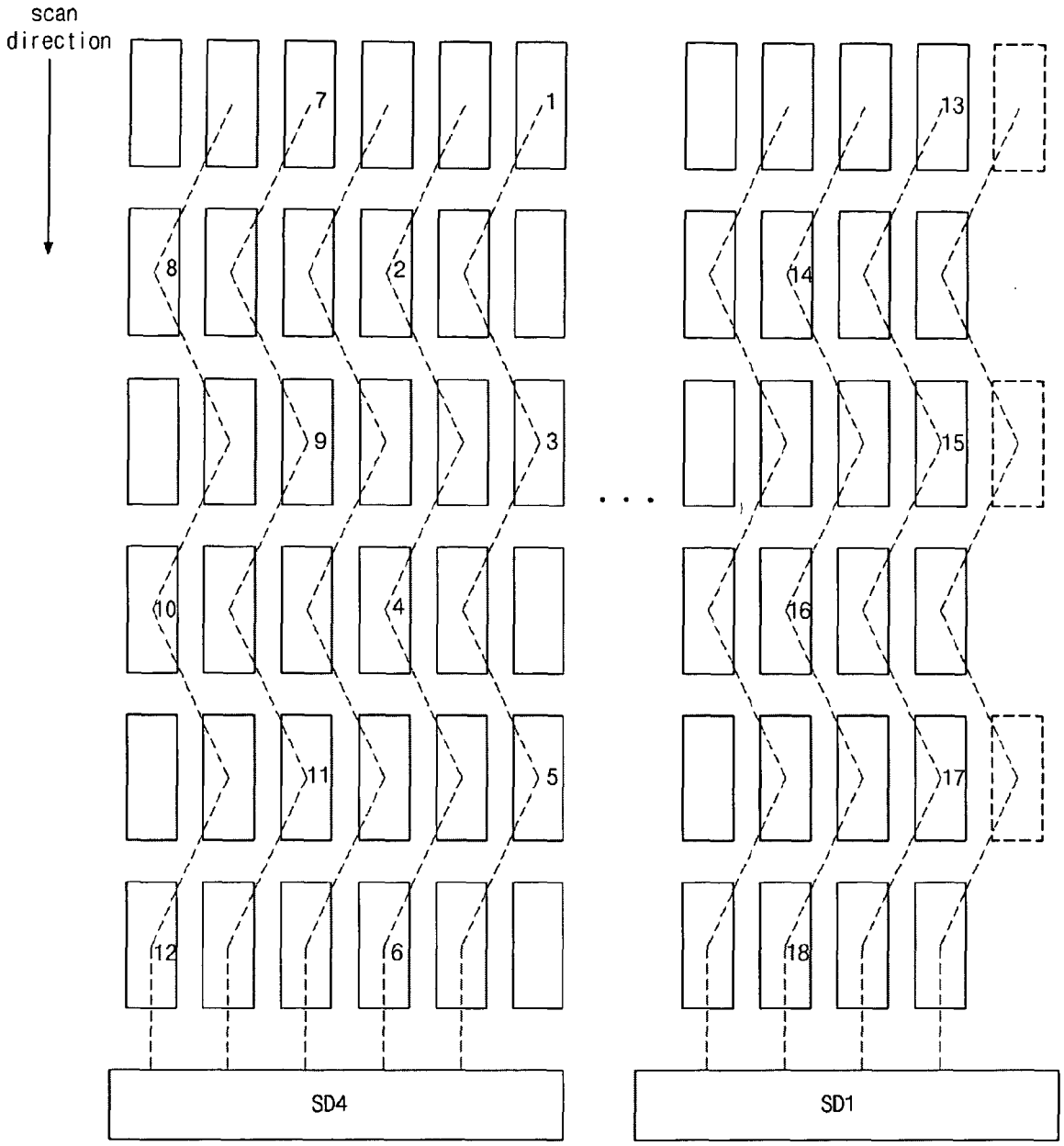

FIG. 13B shows the input status of the image data in the LCD device after the third step st3 and corresponds to FIG. 10. In FIG. 13B, the image data of the first source driving unit SD1 and the fourth source driving unit SD4 are exchanged and rearranged. Still, a normal image is not displayed as that in FIG. 12.

Figure 13C:
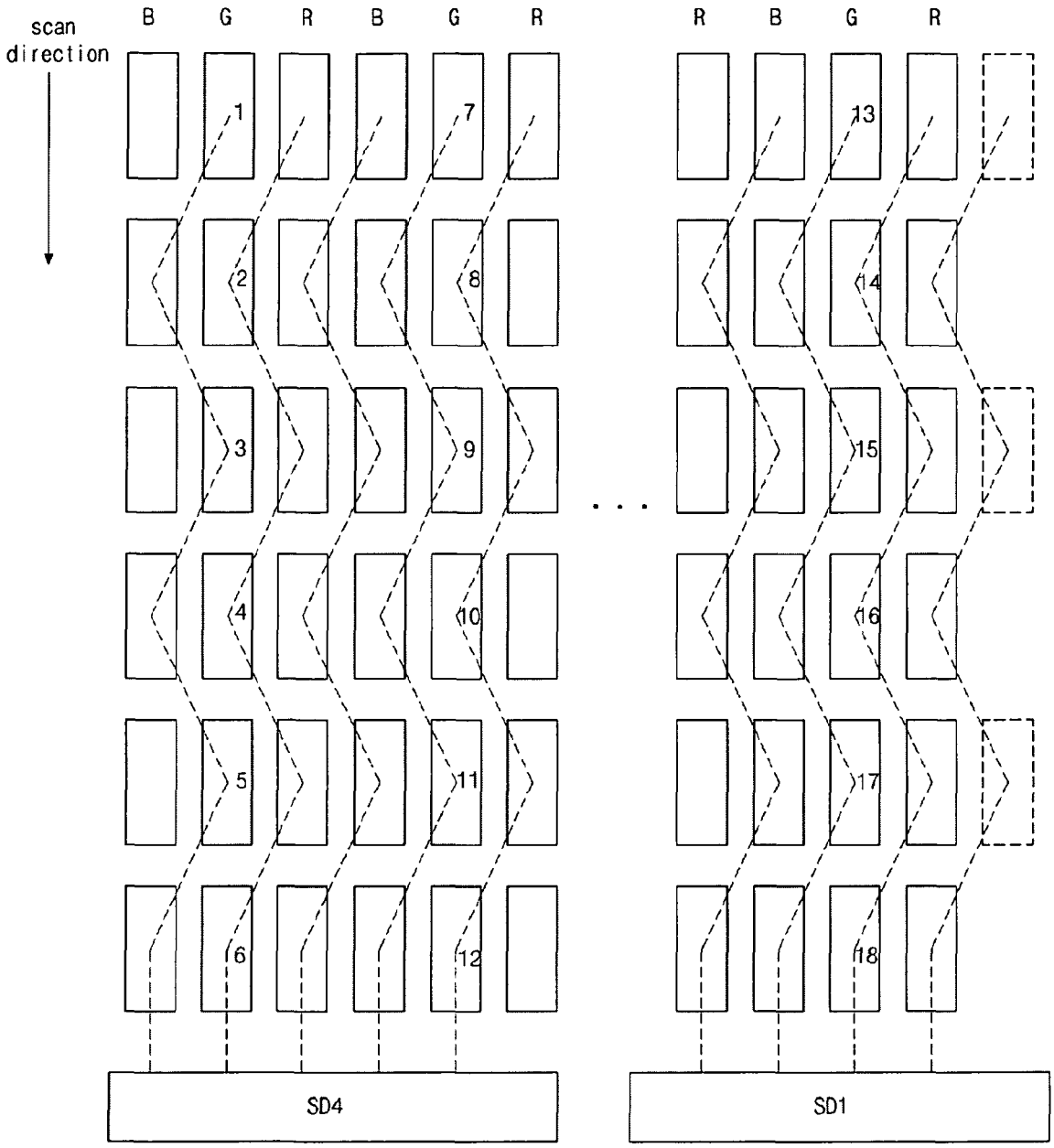

FIG. 13C shows the input status of the image data in the LCD device after the fourth step st4 and corresponds to FIG. 11. In FIG. 13C, the arrangement of the image data outputted from the first source driving unit SD1 and the fourth source driving unit SD4 is reversed. Here, the R-data provided to R color sub-pixels in FIG. 12 are provided to G (green) color sub-pixels.

That is, while the image data are inputted to only the R color sub-pixels in FIG. 12 before the rotation of the LCD device and an R color image is displayed, since the data lines are zigzag connected to the sub-pixels, the image data are inputted to the G color sub-pixels in FIG. 13C after the fourth step st4 and a G color image is displayed.

When the image data are provided to only the G color sub-pixels in FIG. 12, a B color image is displayed after the fourth step st4 of the present invention. When the image data are provided to only the B color sub-pixels in FIG. 12, an R color image is displayed after the fourth step st4 of the present invention. To improve this, it is required to rearrange of the sub-pixels, to which the image data are inputted.

At fifth step st5, to solve the problem that the R-data are inputted to the G color sub-pixels, for example, the image data for the odd horizontal lines are shifted and outputted ahead by a sub-pixel, and the image data for the even horizontal lines are normally outputted.

That is, the present invention relates to the LCD device that includes the data lines zigzag connected to the sub-pixels and receiving the image data, and if the first to fourth steps st1 to st4 are performed to produce the status of FIG. 13C for distributing and rearranging the image data in the timing control unit, the third and fourth steps st3 and st4 regarding the image data are results after distributing and rearranging the image data that substantially are not outputted to the liquid crystal panel.

Figure 14:
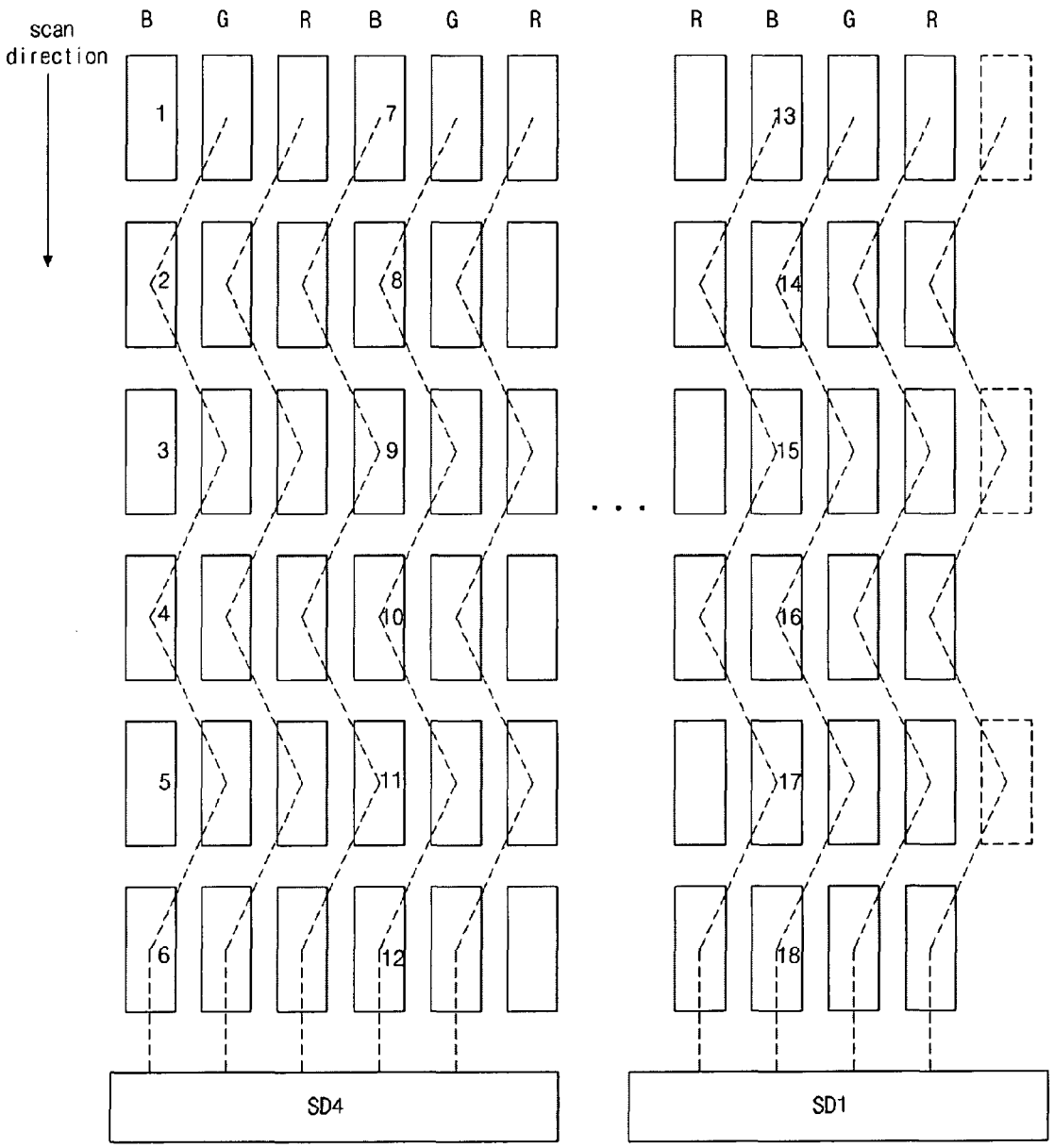

Accordingly, when the image data are outputted to the data lines, the image data inputted to the odd horizontal lines are shifted and outputted ahead by one sub-pixel, and the image data inputted to the even horizontal lines are normally outputted. At this time, according to the data lines zigzag connected to the sub-pixels, the input of the image data is performed from the first sub-pixel, and the R-data are inputted to the B color sub-pixels as shown in FIG. 14.

If the data lines are zigzag connected to the sub-pixels differently from the present invention, the image data inputted to the even horizontal lines may be shifted and outputted ahead by one sub-pixel, and the image data inputted to the odd horizontal lines may be normally outputted.

Therefore, after the distribution and rearrangement of the image data according to the third step st3 and fourth step st4, the source driving units SD1 to SD4 shift and output the image data corresponding to the odd horizontal lines and normally output the image data corresponding to the even horizontal lines.

However, after the fifth step st5, the R-data are inputted to the B color sub-pixels, and not an R color image originally intended but a B color image is displayed.

Figure 15:
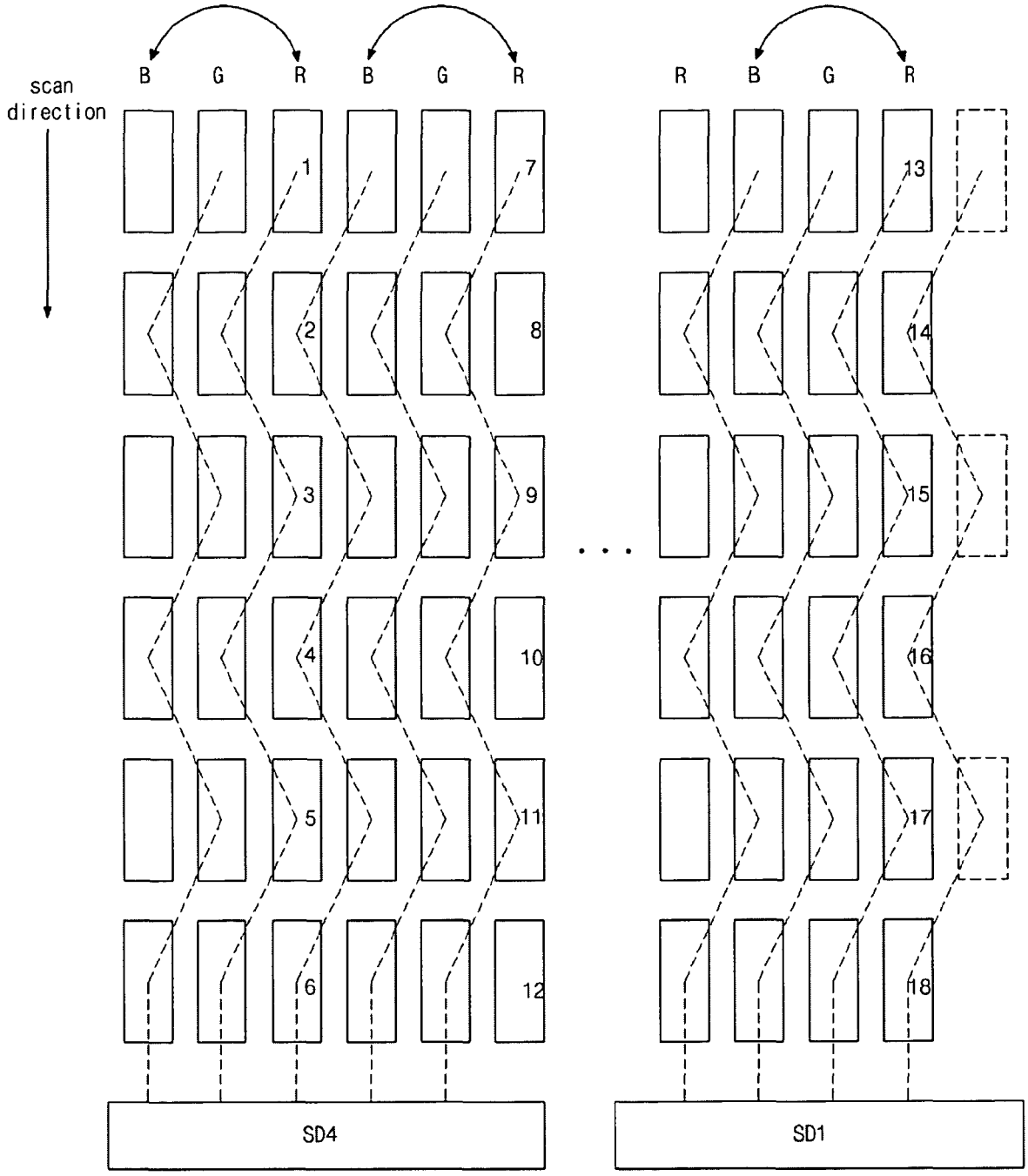

Next, at sixth step st6, the image data of the R color sub-pixels and the B color sub-pixels are exchanged, and thus, as shown in FIG. 15, the R color image, which is the same as the image of FIG. 12, is displayed.

Here, the arrangement of the image data at the fifth step st5 and the sixth step st6, desirably, is performed in the timing control unit providing the image data to the source driving units SD1 to SD4 as the second to fourth steps st2 to st5. More beneficially, an outer circuit unit provides additional distinguishable signals to the timing control unit, and the image data are reestablished by an operation program provided in the timing control unit in advance according to the additional distinguishable signals.

At seventh step st7, the rearrangements of the image data are performed according to the third step st3 to the sixth step st6 after rotating the LCD device, and then the image data are outputted to the liquid crystal panel 210 of FIG. 8 such that the image data synchronize with the scan signals, whereby the same image as that before the rotation is displayed.

According to the present invention, the LCD device having the same structure as the related art may be rotated and driven, and a normal image can be displayed. Therefore, the driving units can be disposed in a different position, and the product including the LCD device can be relatively thin.

It will be apparent to those skilled in the art that various modifications and variations can be made in the present invention without departing from the spirit or scope of the invention. The illustrations of the embodiment described herein are intended to provide a general understanding of the structure of the various embodiments. The illustrations are not intended to serve as a complete description of all of the elements and features of systems that utilize the methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive. The above disclosed subject matter is to be considered illustrative, and not restrictive, and the appended claims are intended to cover all such modifications, enhancements, and other embodiments, which fall within the true spirit and scope of the present invention.

What is claimed is:

1. A rotation driving method of a liquid crystal display device, which includes a liquid crystal panel including pixels composed of first, second and third sub-pixels and arranged in a matrix shape, gate lines receiving scan signals, data lines zigzag connected to the sub-pixels and receiving image data, source driving units connected to the data lines and providing the image data to the data lines, gate driving units connected to the gate lines and providing the scan signals to the gate lines, a timing control unit providing the image data and control signals for driving the source driving units and the gate driving units, wherein the source driving units are disposed to an upper portion of the liquid crystal panel and the gate driving units are disposed at a side portion of the liquid crystal panel, comprising:

a first step of rotating the liquid crystal display device at 180 degrees such that the source driving units are disposed at a lower portion of the liquid crystal panel;

a second step of outputting the scan signals from the gate driving units in reverse order;

a third step of reestablishing the image data provided to the source driving units;

a fourth step of reversing arrangement of the image data outputted to the sub-pixels;

a fifth step of shifting and outputting the image data corresponding to selected ones of odd horizontal lines and even horizontal lines by one sub-pixel;

a sixth step of exchanging the image data for the first and third sub-pixels with each other; and a seventh step of outputting the image data rearranged by the third to sixth steps to the liquid crystal panel such that the image data synchronize with the scan signals according to the second step.

2. The method according to claim 1, wherein the third step includes:

dividing the image data according to an arrangement order of the source driving units before rotation of the liquid crystal display device; and providing the image data divided before the rotation to the source driving units rearranged after the rotation in order.

3. The method according to claim 1, wherein the fourth step includes:

classifying the image data by the horizontal lines; and rearranging the image data corresponding to one horizontal line in reverse order.

4. The method according to claim 1, further comprising a step of providing the image data of a last sub-pixel of each odd horizontal line as first image data of a same odd horizontal line when a first data line is connected to a second sub-pixel of a first horizontal line, and providing the image data of a last sub-pixel of each even horizontal line as first image data of a same even horizontal line when the first data line is connected to a first sub-pixel of the first horizontal line.

5. The method according to claim 1, wherein before rotating the liquid crystal display device, the image data of an mth data line (m is a natural number) is inputted to mth sub-pixels of the odd horizontal lines and (m−1)th sub-pixels of the even horizontal lines in a zigzag shape.

6. The method according to claim 1, wherein the second to seventh steps are controlled by the timing control unit.

* * * * *